US007367207B2

(12) United States Patent
Yang

(10) Patent No.: US 7,367,207 B2
(45) Date of Patent: May 6, 2008

(54) FIGURE WHEEL LOCKING DEVICE

(76) Inventor: Ping-Jan Yang, P.O. Box 26-757, Taipei 106 (TW)

( * ) Notice: Subject to any disclaimer, the term of this patent is extended or adjusted under 35 U.S.C. 154(b) by 109 days.

(21) Appl. No.: 11/495,384

(22) Filed: Jul. 31, 2006

(65) Prior Publication Data

US 2008/0022737 A1 Jan. 31, 2008

(51) Int. Cl.
*E05B 37/00* (2006.01)

(52) U.S. Cl. ..... 70/284; 70/285; 70/312; 70/213; 70/224

(58) Field of Classification Search ..... 70/284, 70/285, 209, 210, 213–216, 190, 312, 224, 70/107, 122, 126, 138, 156, 287, 288, DIG. 63, 70/71

See application file for complete search history.

(56) References Cited

U.S. PATENT DOCUMENTS 4,064,718 A * 12/1977 Cowen ..... 70/302
4,557,122 A * 12/1985 Hwang ..... 70/312
6,598,434 B2 * 7/2003 Yang ..... 70/213
2003/0089147 A1 * 5/2003 Yang ..... 70/284
2004/0011098 A1 * 1/2004 Yang ..... 70/284
2006/0248932 A1 * 11/2006 Yang ..... 70/284

* cited by examiner

*Primary Examiner*—Suzanne Dino Barrett
(74) *Attorney, Agent, or Firm*—Rosenberg, Klein & Lee

(57) ABSTRACT

A figure wheel locking device includes a housing, a key locking mechanism, a pushing assembly, a plurality of figure-detecting members, and a figure locking mechanism. The key locking mechanism is sleeved in the housing. The pushing assembly is movably located in the housing. Each of the figure-detecting members has a first rotating member. The figure locking mechanism has a plurality of figure wheels, and each of the figure wheels has a second rotating member. The direction of the first rotating member is defined as a first rotating axis. The direction of the second rotating member is defined as a second rotating axis. The second rotating axis and the first rotating axis are interlaced to each other. The second rotating member drives the first rotating member. Thereby, the compound locking device having a key locking mechanism and a figure locking mechanism prevents the figure wheels from becoming axially disposed in serial.

10 Claims, 7 Drawing Sheets

FIGURE WHEEL LOCKING DEVICE

BACKGROUND OF THE INVENTION

1. Field of the Invention

The present invention relates to a figure wheel locking device. In particular, this invention relates to a compound figure wheel locking device having a figure locking mechanism and a key locking mechanism.

2. Description of the Related Art

A figure wheel locking device having a figure locking mechanism and a key locking mechanism is usually unlocked by an exact key and an exact figure.

A traditional compound locking device includes a housing, a key locking mechanism located in the housing, a figure locking mechanism, a positioning flake, and a resetting device. Although this compound locking device achieves the goal of having a figure locking mechanism and a key locking mechanism, the figure wheels of the figure locking mechanism are strung by a locking axis and it is easily unlocked. The figure wheels are axially disposed in serial. The user only needs to rotate the figure wheels and listen to the sound produced by the exact figure, and the user can obtain the exact figure to unlock the compound locking device. The locking function fails when the user utilizes the characteristic of axially disposing the figure wheels in serial to obtain the exact figure.

SUMMARY OF THE INVENTION

One particular aspect of the present invention is to provide a figure wheel locking device. It is a compound locking device having a key locking mechanism and a figure locking mechanism. It prevents the problem of being easily unlocked from occurring when other person utilizes the characteristic of axially disposing the figure wheels in serial to obtain the exact figure. The figure wheel locking device can be unlocked by using an exact key or an exact figure.

The figure wheel locking device includes a housing, a key locking mechanism, a pushing assembly, a plurality of figure-detecting members, and a figure locking mechanism. The housing has a through hole and is correspondingly connected with a sleeve. The key locking mechanism is sleeved on the sleeve of the housing and corresponds to the through hole. The key locking mechanism includes a first lock core sleeve, a second lock core sleeve, and a lock core that are sleeved to each other. The first lock core sleeve has a first arc edge and a first plane part. The second lock core sleeve has a second arc edge and a second plane part. The pushing assembly is movably located in the housing and has a first pushing member and a second pushing member. The first pushing member has a first contacting part and a plurality of first supporting parts. The first contacting part is contacted and connected with the first arc edge or the first plane part of the first lock core sleeve. The second pushing member has a second contacting part and a plurality of second supporting parts. The second contacting part is contacted and connected with the second arc edge or the second plane part of the second lock core sleeve. Each of the figure-detecting members has a sleeve member and a first rotating member. There is a flexible member between the sleeve members and the first rotating members. The first supporting parts are individually contacted and connected with the sleeve members. The second supporting parts are individually contacted and connected with the first rotating members. The figure locking mechanism has a plurality of figure wheels. One end of each of the figure wheels has a second rotating member. The direction of the first rotating members is defined as a first rotating axis. The direction of the second rotating members is defined as a second rotating axis. The second rotating axis and the first rotating axis are interlaced with each other. The second rotating members individually drive the first rotating members. Another end of the figure wheels is connected with the housing.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
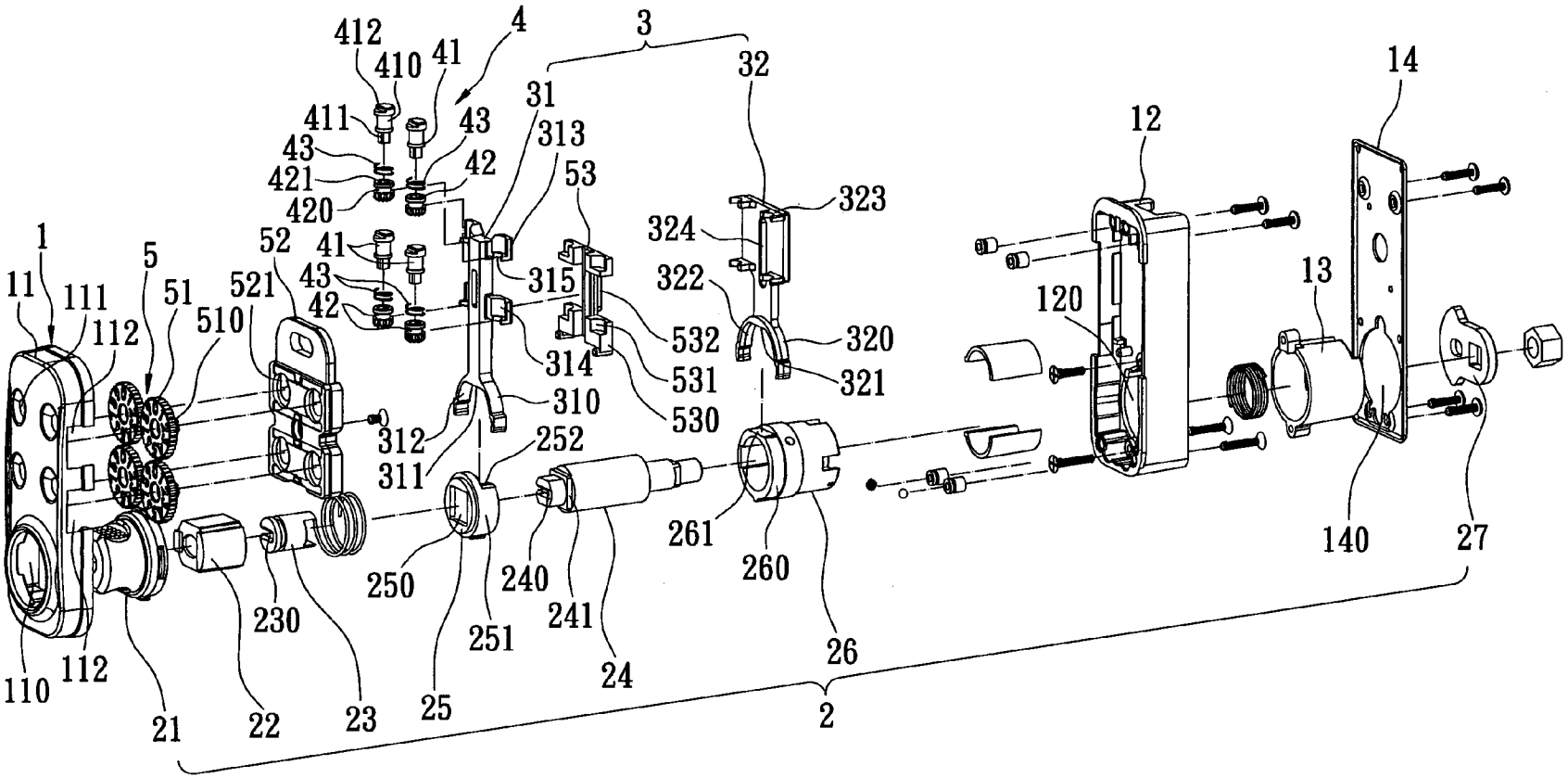
FIG. 1 is an exploded perspective view of the present invention.
Figure 2:
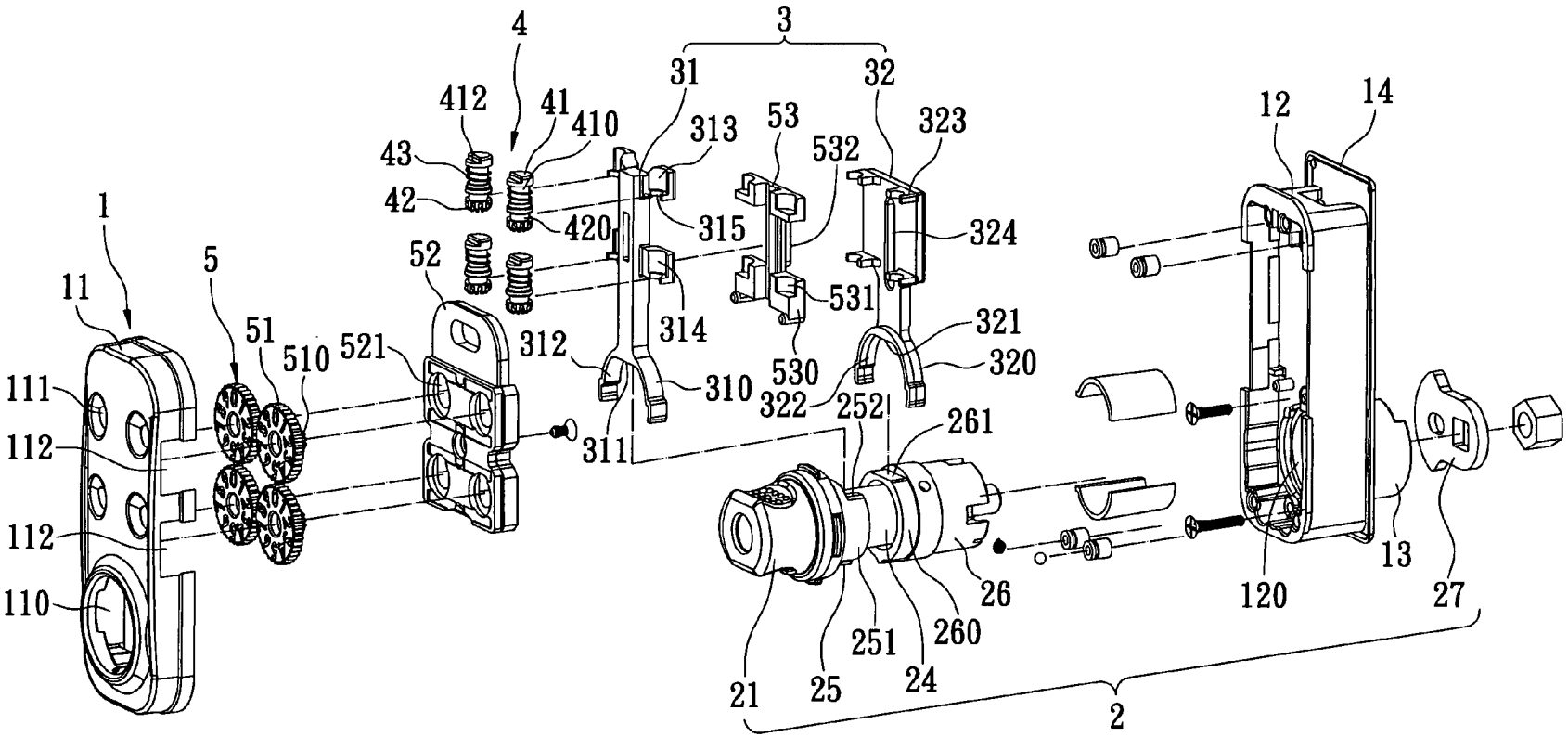
FIG. 2 is another exploded perspective view of the present invention.
Figure 3:
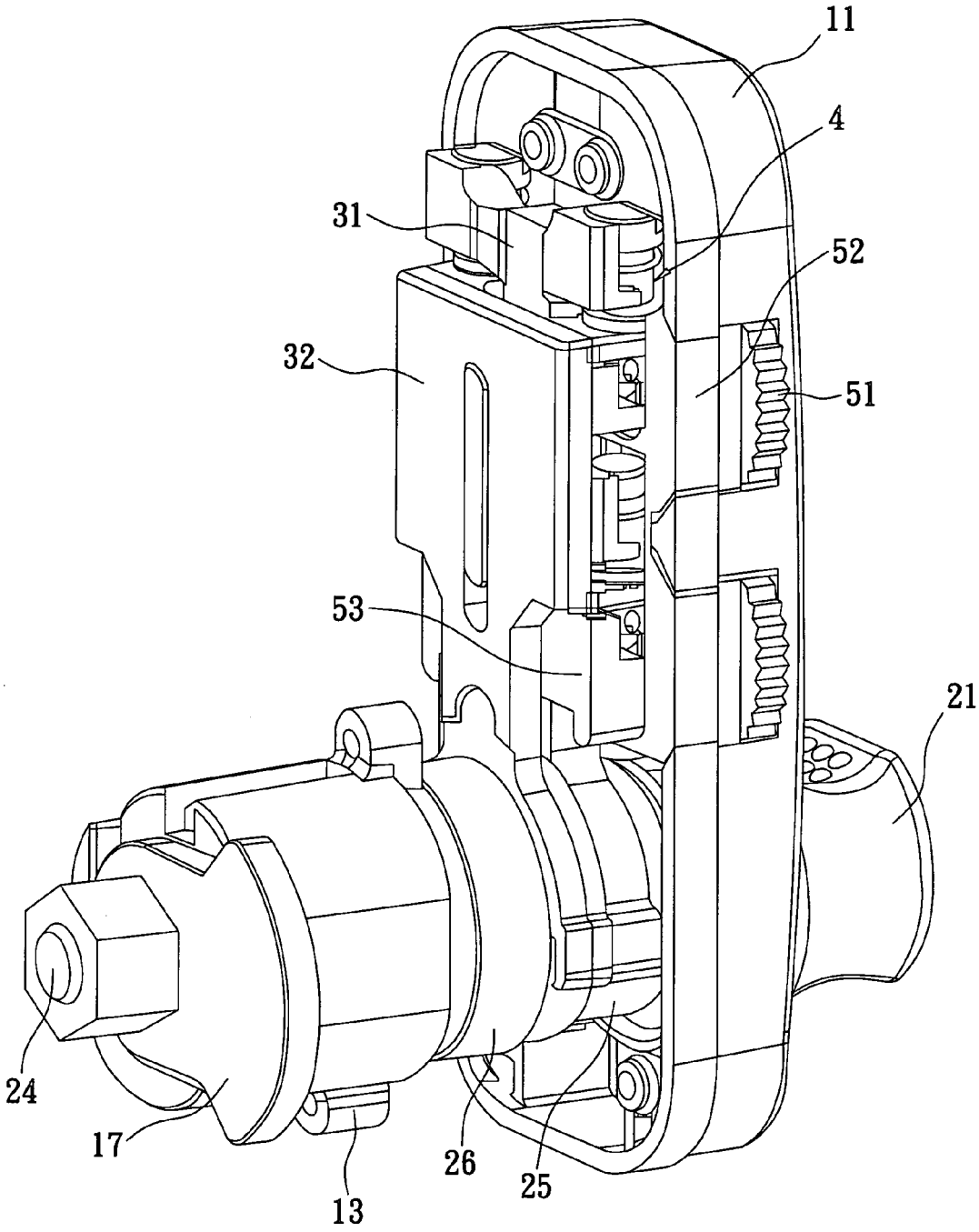
FIG. 3 is a partial assembly perspective view of the present invention.

Reference is made to FIGS. 1~4. The figure wheel locking device of the present invention is a compound locking device having the key locking mechanism and the figure locking mechanism. The figure wheel locking device includes a housing 1, a key locking mechanism 2, a pushing assembly 3, a plurality of figure-detecting members 4, and a figure locking mechanism 5.

The housing 1 has a first shell body 11 and a second shell body 12 that are jointed together. On the front side of the first shell body 11, there is a through hole 110 and a plurality of windows 111. On the side of the first shell body 11, there are a plurality of openings 112. The second shell body 12 has another through hole 120. The housing 1 is connected with a sleeve 13 that is hollow. The sleeve 13 is connected with the second shell body 12 and corresponds to the two through holes 110 and 120. The housing 1 further is connected with a back board 14. The back board 14 has a through hole 140. The through hole 140 corresponds to the sleeve 13 and the back board 14 is screwed on the second shell body 12 of the housing 1.

The key locking mechanism 2 is sleeved on the sleeve 13 of the housing 1 and corresponds to the through hole 110 of the first shell body 11 of the housing 1. The key locking mechanism 2 includes a turning head 21, an inner shell 22 sleeved in the turning head 21, a lock core front sleeve 23 having a key hole 230 and plugged into the inner shell 22, a lock core 24 having another key hole 240 and connected with the lock core front sleeve 23, a first lock core sleeve 25 sleeved on the lock core 24, and a second lock core sleeve 26 sleeved on the lock core 24 and being adjacent to the first lock core sleeve 25, which are sleeved to each other. The key locking mechanism 2 has a function that is the same as the general key lock. The lock core 24 has a jointing part 241 that has a rectangular shape. The first lock core sleeve 25 has a rectangular jointing hole 250. The jointing hole 250 is sleeved on the jointing part 241 to joint the first lock core sleeve 25 with the lock core 24. The first lock core sleeve 25 has a first arc edge 251 and a first plane part 252 that are located at the same rotating path. The second lock core sleeve 26 also has a second arc edge 260 and a second plane part 261 that are located at the same rotating path. After the key locking mechanism 2 is assembled, the turning head 21 protrudes out of the housing via the through hole 110 and is turned by the user's hand.

The pushing assembly 3 is movably located in the housing 1 and has a first pushing member 31 and a second pushing member 32. On end of the first pushing member 31, there is a first contacting part 310. The first contacting part 310 has a first positioning surface 311 and a first contacting surface 312 that has a similar arc shape. From another end of the first pushing member 31, a plurality of first supporting parts 313 extend to two sides of the first pushing member 311. Each of the first supporting parts 313 has an arc surface 314 that has a semi-arc shape, and a semi-circular jointing arm 315 extended from a proper location of the arc surface 314. One end of the second pushing member 32 has a second contacting part 320. The second contacting part 320 has a second positioning surface 321 and a second contacting surface 322 that has a similar arc shape. From another end of the second pushing member 32, a plurality of semi-arc shaped second supporting parts 323 extend forward. On the second pushing member 32, there is a sliding slot 324 passing through the second pushing member 32. The sliding slot 324 is located between the second supporting parts 323.

Each of the figure-detecting members 4 has a sleeve member 41 and a first rotating member 42. The sleeve member 41 has a circular column shape and has a concave-ring part 410, a wedged part 411 and a cutting slot 412. The first rotating member 42 is a bevel gear and has a circular column shape. Each of the first rotating members 42 has a concave jointing part 420 and a blind hole 421. The wedged parts of the sleeve members 41 are individually movably located in the blind holes 421 of the first rotating member 42. There is a flexible member 43 between the sleeve members 41 and the first rotating members 42. The flexible member 43 is a compressed spring.

Figure 5:
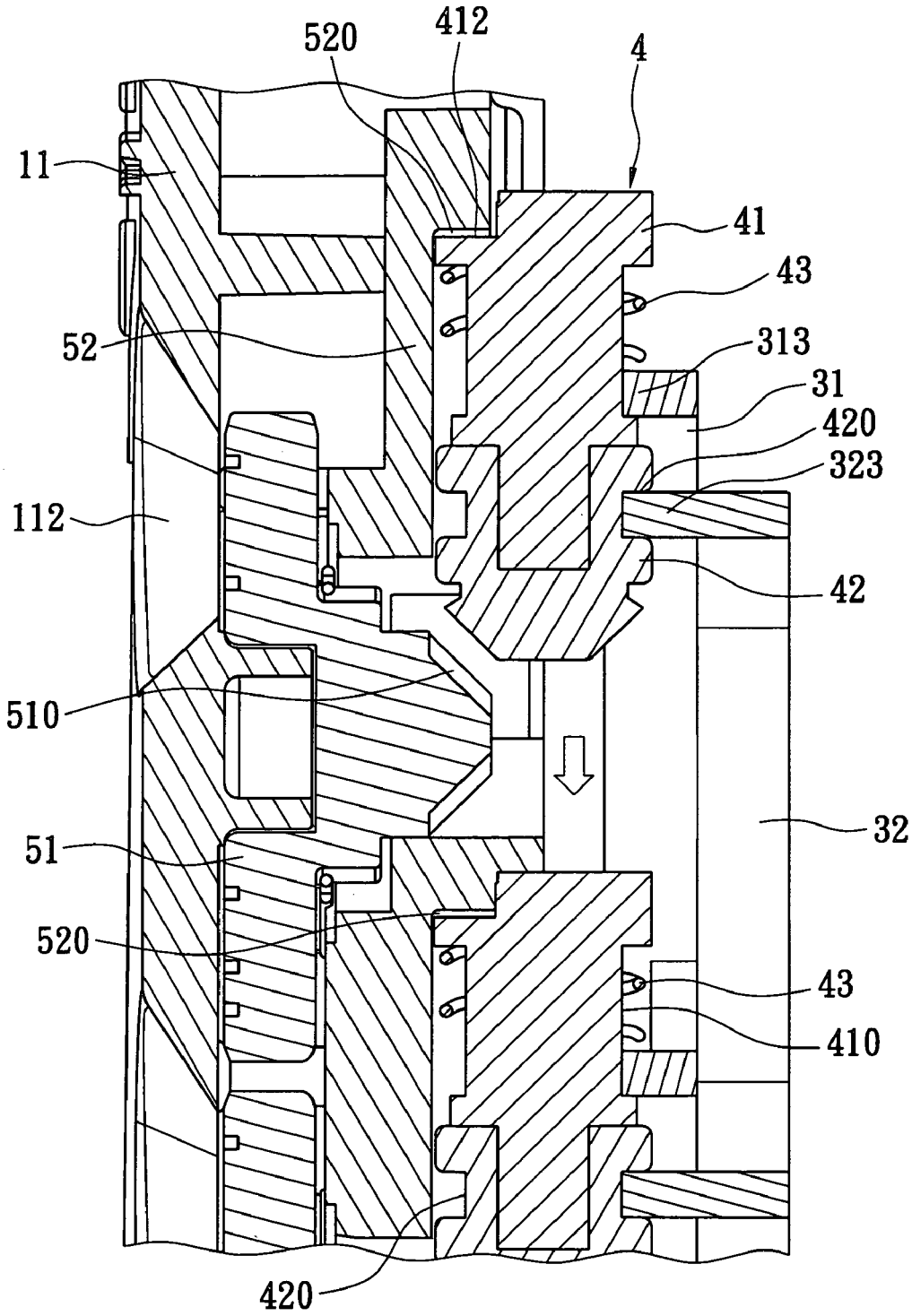
FIG. 5 is a first schematic diagram of the operation of the present invention.
Figure 6:
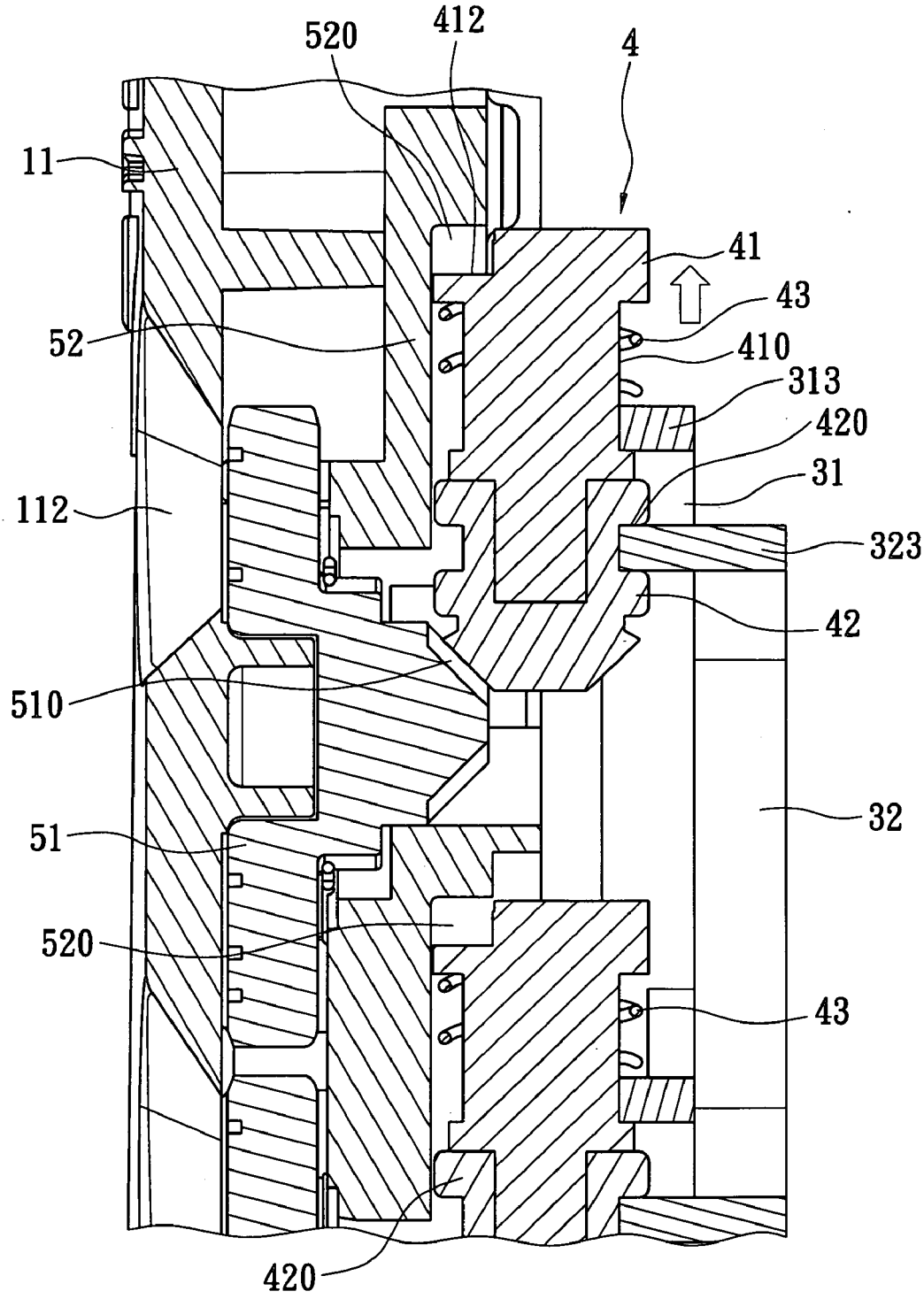
FIG. 6 is a second schematic diagram of the operation of the present invention.
Figure 7:
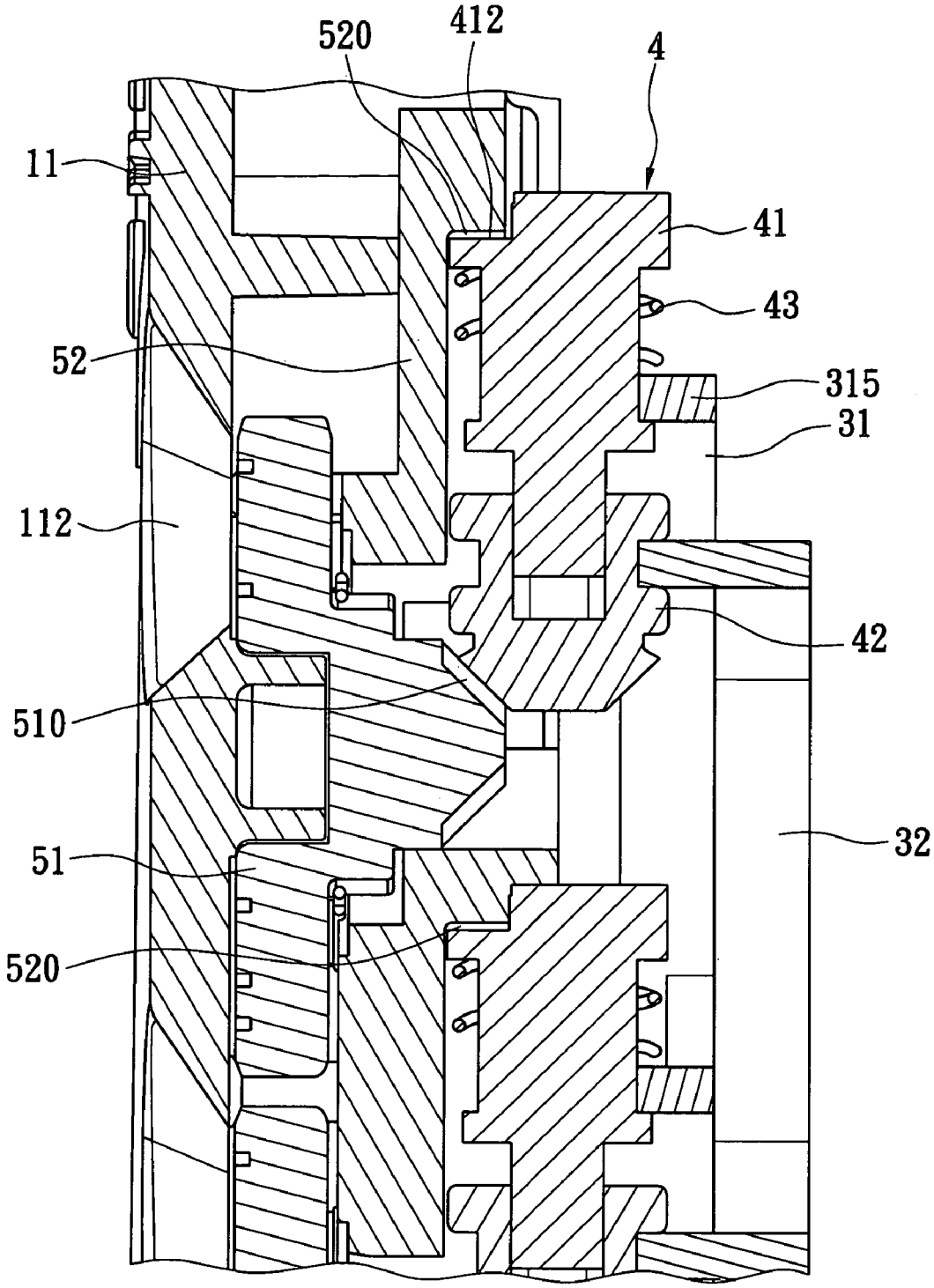
FIG. 7 is a third schematic diagram of the operation of the present invention.

The figure locking mechanism 5 has a plurality of figure wheels 51, a front pressing board 52, and a rear pressing board 53. One end of each of the figure wheels 51 has a second rotating member 510. The second rotating member 510 is a bevel gear. The front pressing board 52 has a similar rectangular shape, and has a concave part 520 located at the rear side (as shown in FIG. 5) and a plurality of circular openings 521 that correspond to each other and pass through the front pressing board 52. A plurality of fixing parts 530 extends to two sides of the rear pressing board 53. The fixing parts 53 correspond to each other and each of the fixing parts 53 has an arc-shaped jointing surface 531. The rear pressing board 53 has a convex block 532 and the convex block 532 is located at the rear side of rear pressing board 53 and extends outward at a distance.

The first contacting surface 312 or the first positioning surface 311 of the first contacting part 310 of the first pushing member 31 is movably contacted and connected with the first arc edge 251 or the first plane part 252 of the first lock core sleeve 25. The second contacting surface 322 or the second positioning surface 321 of the second contacting part 320 of the second pushing member 31 is movably contacted and connected with the second arc edge 260 or the second plane part 261 of the second lock core sleeve 26. The concave-ring parts 410 of the sleeve members 41 of the figure-detecting members 4 are individually contacted and connected with the jointing arms 315 of the first supporting part 313 and correspond to the arc surfaces 314. The concave-jointing parts 420 of the first rotating members 42 of the figure-detecting members 4 are individually contacted and connected with the second supporting parts 323.

Figure 4:
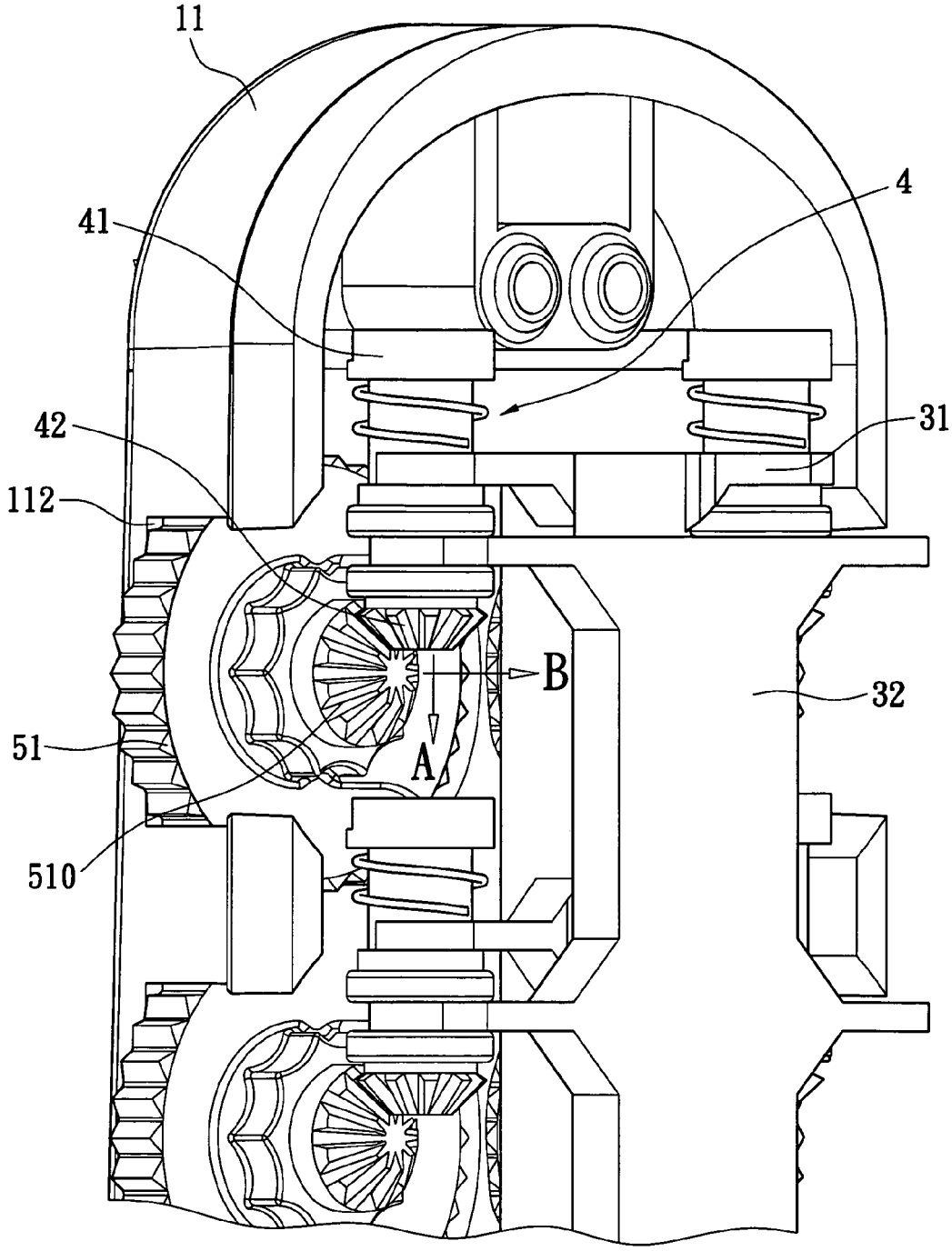
FIG. 4 is another partial assembly perspective view of the present invention.

The second rotating members 510 of the figure wheels 51 are individually plugged into the openings 521 of the front pressing board 52, and the front pressing board 52 is screwed in the first shell body 11 of the housing 1. Therefore, another end of the figure wheels 51 is contacted and connected with the window 111 of the first shell body 11 of the housing 1 and exposed to the outside of the openings 11, and is operated by the user. The rear pressing board 53 pushes and presses the first pushing member 31 to position the first pushing member 31 between the front pressing board 52 and the rear pressing board 53 and make the cutting slot 412 of the figure-detecting member 4 correspond to the concave part 520 of the front pressing board 52 (as shown in FIG. 5). At the same time, the jointing surfaces 531 of the fixing parts 530 individually correspond to first rotating members 42 of the figure-detecting member 4. The rear pressing board 53 is screwed at the rear side of the front pressing board 52. The sliding slot 324 of the second pushing member 32 is slidingly located at the convex block 532 of the rear pressing board 53. Thereby, the first rotating members 42 are individually interlinked with the second rotating members 510. The direction of the first rotating members 42 is defined as a first rotating axis A. The direction of the second rotating members 510 is defined as a second rotating axis B. The second rotating axis B and the first rotating axis A are interlaced to each other. The second rotating members 510 individually drive the first rotating members 42 (as shown in FIG. 4).

The rear side of the lock core 24 of the key locking mechanism 2 extends to outside of the sleeve 13 and has a locking tongue flake 27.

Reference is made to FIGS. 5~7 and FIGS. 2~3. When the user plugs the exact key, the key is plugged into the key hole 230 of the lock core front sleeve 23 and the key hole 240 of the lock core 24. By rotating the lock core 24 of the key locking mechanism 2 to drive the locking tongue flake 27, the lock is unlocked.

When the user does not use the key, the user presses and rotates the turning head 21 of the key locking mechanism 2 to drive the lock core 24 (at this moment, the locking tongue flake 27 is not driven to unlock the lock). The lock core 24 drives the first lock core sleeve 25 and the second lock core sleeve 26 to rotate from a twelve-clock direction to a nine-clock direction. The first contacting surface 312 of the first contacting part 310 of the first pushing member 31 originally contacts the first arc edge 251 of the first lock core sleeve 25. It is a rising status. The second contacting surface 322 of the second contacting part 320 of the second pushing member 32 also originally contacts the second arc edge 260 of the second lock core sleeve 26. It also is a rising status. By rotating the first lock core sleeve 25 and the second lock core sleeve 26, the first positioning surface 311 of the first contacting part 310 of the first pushing member 31 contacts the first plane part 252 of the first lock core sleeve 25. The second positioning surface 321 of the second contacting part 320 of the second pushing member 32 contacts the second plane part 261 of the second lock core sleeve 26. Both the first pushing member 31 and the second pushing member 32 change to be in a falling status. At this moment, the second supporting part 323 of the second pushing member 32 drives the first rotating, member 42 to make the first rotating member 42 be interlinked with-the second rotating member 510.

When the user rotates the figure wheels 51 to the exact figures, the sleeve member 41 and the flexible member 43 of the figure-detecting member 4 movably push the first pushing member 31 so as to make the first positioning surface. 311 of the first contacting part 310 of the first pushing member 31 contact the first plane part 252 of the first lock core sleeve 25. Therefore, the first pushing member 31 moves upward at a distance to escape from the first plane part 252 of the first lock core sleeve 25. Thereby, when the user rotates the turning head 21 again, the turning head drives the lock core front sleeve 23 and lock core 24 to drive the locking tongue flake 27. The lock is then unlocked.

The present invention interlaces the first rotating axis A and the second rotating axis B of the first rotating members 42 and the second rotating members 510 to prevent the figure wheels from being axially disposed in serial. Therefore, the problem of figure wheels not working well due to the figure wheels being axially disposed in serial is solved. The lock can be unlocked by an exact key or an exact figure.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A figure wheel locking, comprising:

a housing having a through hole that is correspondingly connected with a sleeve;

a key locking mechanism sleeved on the sleeve of the housing and corresponding to the through hole, wherein the key locking mechanism includes a first lock core sleeve, a second lock core sleeve, and a lock core that are sleeved to each other, the first lock core sleeve has a first arc edge and a first plane part and the second lock core sleeve has a second arc edge and a second plane part;

a pushing assembly movably located in the housing and having a first pushing member and a second pushing member, wherein the first pushing member has a first contacting part and a plurality of first supporting parts, the first contacting part is contacted and connected with the first arc edge or the first plane part of the first lock core sleeve, and the second pushing member has a second contacting part and a plurality of second supporting parts and the second contacting part is contacted and connected with the second arc edge or the second plane part of the second lock core sleeve;

a plurality of figure-detecting members, wherein each of the figure-detecting members has a sleeve member and a first rotating member, there is a flexible member between the sleeve members and the first rotating members, and the first supporting parts are individually contacted and connected with the sleeve members and the second supporting parts are individually contacted and connected with the first rotating members; and a figure locking mechanism having a plurality of figure wheels, wherein one end of each of the figure wheels has a second rotating member, the direction of the first rotating members is defined as a first rotating axis and the direction of the second rotating members is defined as a second rotating axis, and the second rotating axis and the first rotating axis are interlaced to each other, wherein the second rotating members individually drive the first rotating members, and another end of the figure wheels is connected with the housing.

2. The figure wheel locking as claimed in claim 1, wherein the housing comprises a first shell body and a second shell body that are jointed together, the through hole is formed on the first shell body and the second shell body, and the sleeve is connected with the second shell body.

3. The figure wheel locking as claimed in claim 1, wherein the housing is further connected with a back board, the back board has a through hole and the through hole corresponds to the sleeve.

4. The figure wheel locking as claimed in claim 1, wherein the housing comprises a plurality of windows and a plurality of openings, the figure wheels individually correspond to the windows and are exposed to an outside of the openings.

5. The figure wheel locking as claimed in claim 1, wherein the lock core comprises a jointing part, the first lock core sleeve comprises a jointing hole, and the jointing hole is sleeved on the jointing part.

6. The figure wheel locking as claimed in claim 1, wherein each of the sleeve members comprises a wedged part, each of the first rotating members comprises a blind hole, and the wedged parts are movably and individually located in the blind holes.

7. The figure wheel locking as claimed in claim 1, wherein the lock core comprises a turning head protruding to the outside of the housing, and the rear side of the lock core extends to an outside of the sleeve and has a locking tongue flake.

8. The figure wheel locking as claimed in claim 1, wherein the figure locking mechanism further comprises a front pressing board and a rear pressing board, the front pressing board has a plurality of openings, the second rotating members of the figure wheels are individually plugged into the openings of the front pressing board, the front pressing board is screwed in the housing, and the rear pressing board pushes and presses the first pushing member to position the first pushing member between the front pressing board and the rear pressing board.

9. The figure wheel locking as claimed in claim 8, wherein the front pressing board comprises a concave part, each of the sleeve members has a cutting slot, and the cutting slots correspond to the concave part of the front pressing board.

10. The figure wheel locking as claimed in claim 8, wherein the rear pressing board comprises a convex block, the second pushing member has a sliding slot, and the sliding slot is slidingly located at the convex block.

* * * * *